United States Patent [19]

Campbell et al.

[11] 4,082,360

[45] Apr. 4, 1978

[54] MINING APPARATUS AND METHOD

[75] Inventors: John A. L. Campbell, Action; Daniel J. Moynihan, Chelmsford, both of Mass.

[73] Assignee: Peabody Coal Company, Belleville, Ill.

[21] Appl. No.: 698,885

[22] Filed: Jun. 23, 1976

[51] Int. Cl.[2] ..... E21D 15/48; E21D 23/04

[52] U.S. Cl. ..... 299/33; 61/45 D; 299/43

[58] Field of Search ..... 299/11, 10, 32, 33, 299/43, 18; 61/45 D; 198/313, 312, 632

[56] References Cited

U.S. PATENT DOCUMENTS

| | | | |
|---|---|---|---|
| 3,649,078 | 3/1972 | Grebe et al. | 299/32 |
| 3,856,356 | 12/1974 | Allen | 299/11 |
| 3,874,734 | 4/1975 | Plevak et al. | 299/32 |
| 4,041,715 | 8/1977 | Watermann | 61/45 D |
| 4,045,715 | 8/1977 | Peake | 61/45 D |

FOREIGN PATENT DOCUMENTS

| | | | |
|---|---|---|---|
| 1,290,507 | 3/1969 | Germany | 299/32 |

*Primary Examiner*—Ernest R. Purser
*Assistant Examiner*—William F. Pate, III
*Attorney, Agent, or Firm*—Littlepage, Quaintance, Murphy, Richardson and Webner

[57] ABSTRACT

An articulated ancillary support for a conveyor is attached onto the forward side of a mine roof chock by extensible means which, when retracted towards the chock, shifts the ancillary support from a normal condition in which it occupies an area of relatively wide lateral extent to another condition in which it overlies an area of relatively narrow lateral extent, freeing a large portion of the space under the chocks to clear the way for a retreating continuous miner.

16 Claims, 17 Drawing Figures

14
86
18
16
20
22
36
30
28
12
38
6
4
2
10
8
48
42
24
44
40

MINING APPARATUS AND METHOD

RELATED APPLICATION

Campbell and Moynihan MINING METHOD AND APPARATUS, filed Apr. 20, 1976, Ser. No. 678,680, the disclosure of which is incorporated by reference herein.

FIELD OF INVENTION

Mining Or In Situ Disintegration of Hard Material, Hard Material Disintegrating Machines, With Mine Roof Supporting Means.

OBJECTS

In typical long-wall mining, a row of chocks is advanced forwardly towards the panel face as the plow or other device removes the coal from the face, and the coal falls down onto a drag chain conveyor which is supported in a series of semi-permanent connected sections, each of which is attached to the front side of a chock, usually by an extensible-retractable device such as a hydraulic ram, so that the conveyor sections can be aligned and kept at the desired distance from the face, and retracted towards and extended from the chocks.

More recently, a modification of this system has come into being, wherein a continuous miner is used in short-wall mode, and a row of chocks advance, one-by-one, behind the continuous miner. The coal is carried away from the continuous miner by various means, such as a flexible conveyor train. See, for example, Joy Manufacturing Company Bulletin J-321 "Continuous Pillar Mining." According to this newer mode, after the continuous miner has cut through a coal panel a certain distance, for example, from one entry to another, it backs out through the cut it has just made and starts a new cut. The flexible conveyor train, or piggyback conveyor system, has to back out also to clear the way for the continuous miner to back out behind it.

It would be advantageous to utilize the chock-attached articulated ancillary support system in Campbell et al (supra) for supporting a conveyor system in this short-wall method, but it may, if used in low heights and with conventional equipment, result in insufficient height to clear the back-out path of the continuous miner. The extensible-retractable conveyor supports previously used on chocks are not usable for practicing the new method because, even when the conveyor is retracted, the ancillary support system still occupies too much of an area at the front sides of the chocks to permit kthe continuous miner to back out past them.

In addition, certain commercially available face conveying systems require more height in which to operate than others, and when sufficient height is unavailable, as in certain mines, these conveying systems, including a roof-supported conveyor, cannot be used. It also may be more desirous to use a floor supported conveyor, for example because of poor roof conditions, than a roof supported system.

The object of this invention is to provide an articulated ancillary support system which has extensible-retractable means for attaching a conveyor support section to a chock, together with a mechanism which, when actuated to retract the conveyor support, shifts the conveyor support from its normal condition in which it occupies an area of relatively great lateral extent to a condition in which it occupies an area of relatively small lateral extent, clearing a space to allow the continuous miner a pathway to back out from under the chock supports.

The conveyor support may partake of any one of numerous forms, as may the mechanism for shifting the area of lateral extent which they occupy, all as will be apparent from the following specification and drawings, in which.

Figures 1, 2:
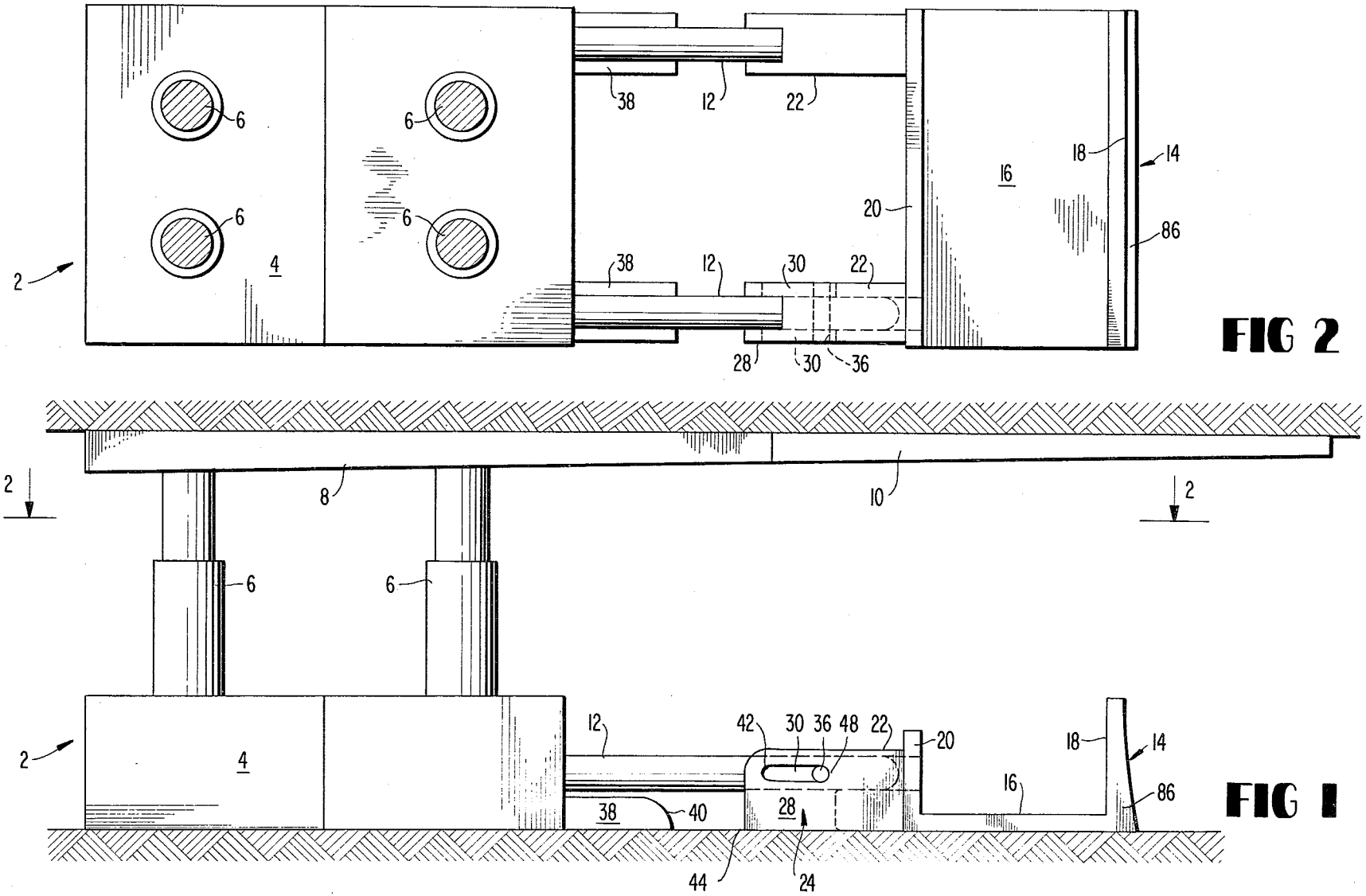
FIG. 1 is a side elevation of a chock with a solid conveyor support section in a normal position at one side thereof.
FIG. 2 is a section along the lines 2—2 of FIG. 1.
Figure 3:
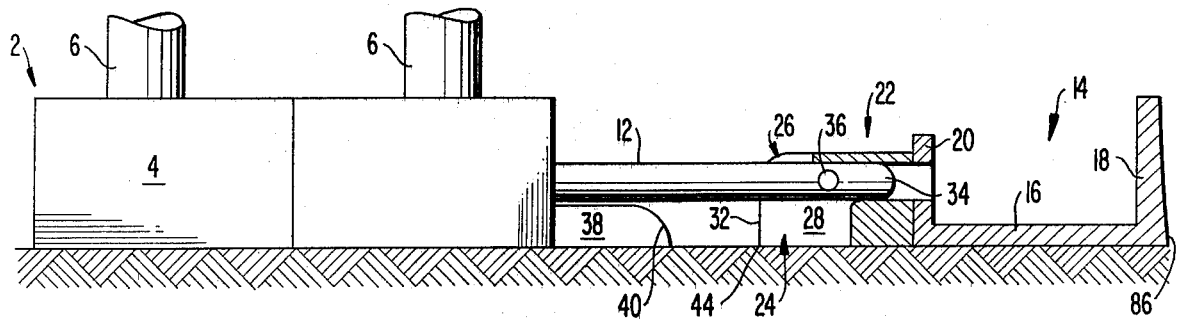
FIGS 3, 4, 5 and 6 are views similar to FIG. 1, with the upper portion of the chock broken off, showing successive positions of the parts from the start to the finish of the solid conveyor support from its outer to its inner extremity.
Figure 4:
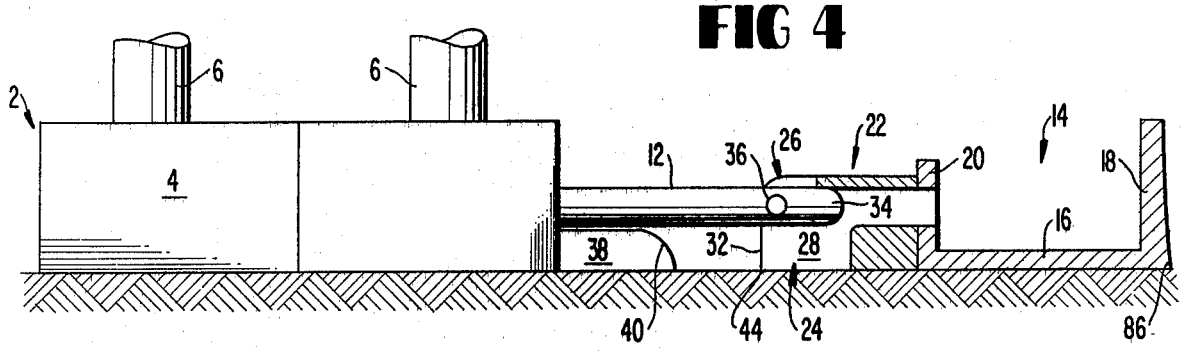

Referring first to FIGS. 1–7 of the drawings, in which like whole number reference numerals denote similar elements, and letters "*a*," "*b*" and "*c*" suffixes are used with reference numerals to denote elements comparable to those previously designated with whole number reference numerals, the essentials only of a chock 2 are illustrated, these conventionally comprising a base 4, and hydraulic jacks 6 which, when extended upwardly, force a roof beam 8 against a mine roof. An arm 10 is diagrammatically illustrated, it being understood that such arms are frequently made extensible by one means or the other, so that they can be retracted inwardly so as to be co-extensive, or substantially so, with the main portion of roof beam 8, and extended outwardly so as to engage against the mine face. As is also conventional in the art, the subject chock has one or more hydraulic rams 12 whose cylinders (not shown) are housed in base 4, which project from the forward side of the chock base 4. The hydraulic rams are for extending outwardly or retracting inwardly a channel section 14 whose base 16 and flanges 18 and 20 constitute a conveyor support. In conventional long wall coal mining, in place of sections 14, double decked channels which are attached to adjacent chocks, are joined together in a non-articulated manner to support and guide a drag chain conveyor which carries off the coal which is plowed or sheared from the mine face. According to this invention, however, when the ends of adjacent channels 14 are joined together, they form an articulated supportway for a conveyor system, such as a Joy Flexible Conveyor Train or a Jeffrey Multi-Unit Cascading Continuous Hauling System, the essential features of which are that, as each chock is moved in behind a continuous miner, the conveyor system can be extended along with it to haul the mined material away.

On the outer side of flange 20 are secured a pair of open-ended sockets 22 whose bottoms are cut-away as indicated at 24 and whose tops are cut away as indicated at 26, and whose spaced side walls 28 have a pair of longitudinally extending slots 30 therein. As will be apparent hereinafter the cut-away portions of the bottoms and tops of the sockets are to accommodate the rams when the conveyor support is tipped up. The side walls of the sockets have flat free end edges 32.

Rams 12 have rounded forward end portions 34, spaced rearwardly from which cross pins 36 are affixed, the cross pins slidably engaging in slots 30 in the opposite side walls of the sockets. Outwardly projecting cams 38 on the chock base have upwardly and outwardly facing cam surfaces 40 which, as will be apparent hereinafter, engage against the free end edges 32 of the side walls of the sockets.

The operation of the mechanism is as follows: Let it be assumed that the channel 14 is extended to its extreme outer position from chock base 4, as illustrated in FIGS. 1 and 2. In this condition base 16 of the channel section is disposed laterally outward from the chock base and rests on the mine floor and serves as a support for a conveyor mechanism. The rounded forward edge portions 34 of rams 12 are engaged in the sockets 22, so that the channel 14 is firmly held against tipping displacement. When the channel is to be retracted, rams 12 are drawn inwardly and cross pins 36 slide in slots 30 until they engage the ends 42 of the slots (FIGS. 1 and 4), whereupon further retractive movements of the rams draw the channel 14 inwardly until the surfaces 40 on cams 38 are engaged by the lower corners 44 of the socket side walls 28, whereupon the camming action commences (FIG. 5), and channel 14 is tipped up until the end edges 32 of the socket side walls rest upon the flat upper surfaces 46 of the cams. In this condition the channel section 14 is locked in a tipped-up position alongside the chock base 4, and the area formerly occupied by it is cleared.

Figure 5:
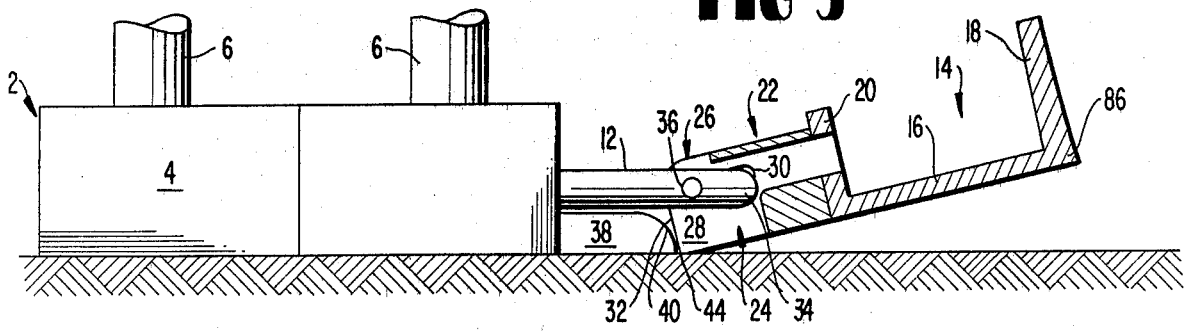
Figure 6:
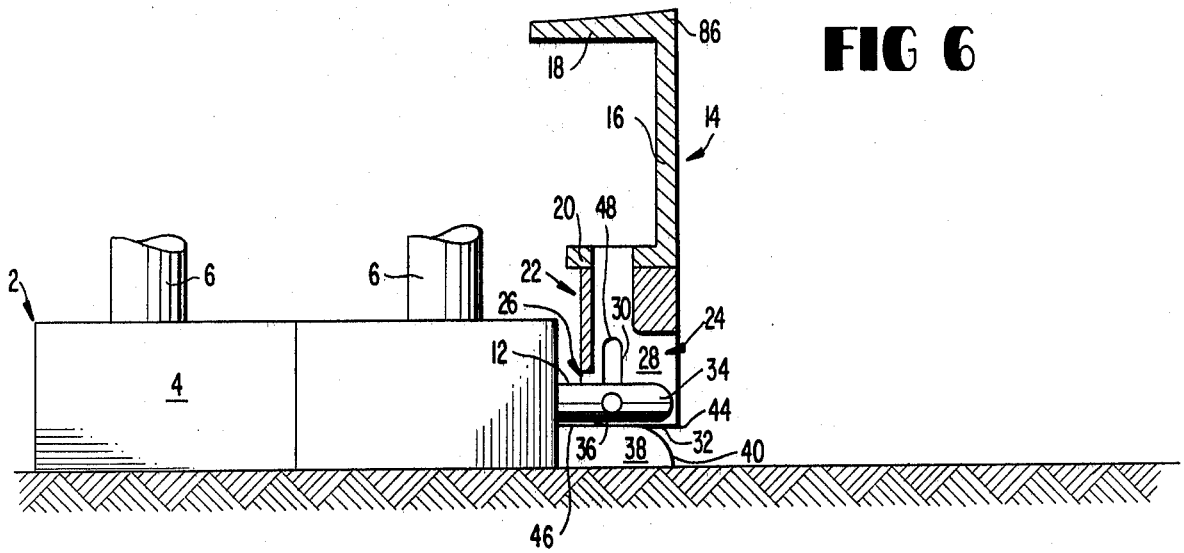
Figure 7:
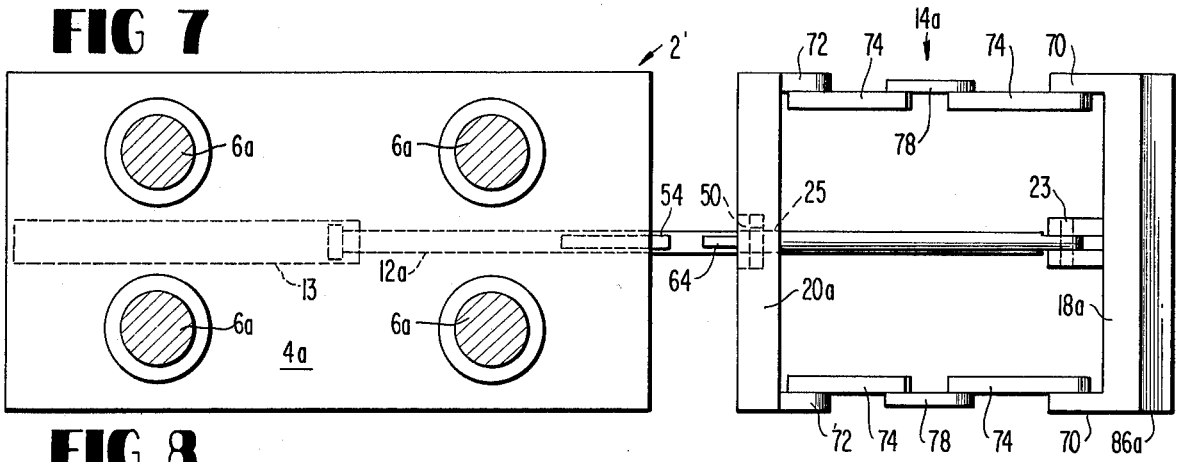
FIG. 7 is a plan view partly in horizontal cross section of a chock with a first modification of a conveyor support extended at one side thereof.

When channel section 14 is to be returned to its forwardly extended position, the action is reversed. As rams 12 move outwardly from the FIG. 6 position, the end edges 32 of the ends of the socket side walls slide down the cam surfaces 40 (FIG. 5). Further outwardly movement of rams 12 engage their outer rounded end portions 34 in the sockets, thereby locking channel member 14 in its normal position. Simultaneously, cross pins 36 engage against slot ends 48, so that further outward motion of the rams move the channel outwardly. The channels can be juxtaposed so that those connected to adjacent chocks form a continuous channel support. Conventional means (not shown) can be employed for locking the adjacent ends of the channel together, for example, such means are shown in our co-pending application, supra.

Figure 8:
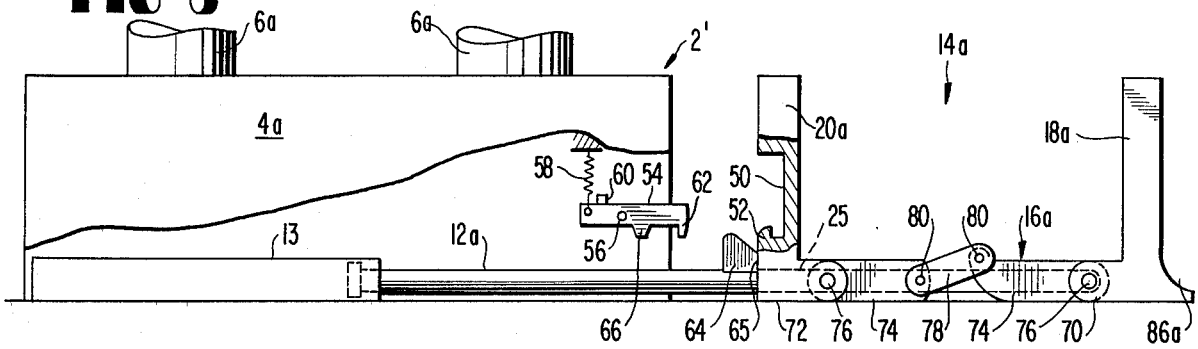
FIG. 8 is an end view, broken away, of the first modification with the conveyor support extended as shown in FIG. 7.
Figure 9:
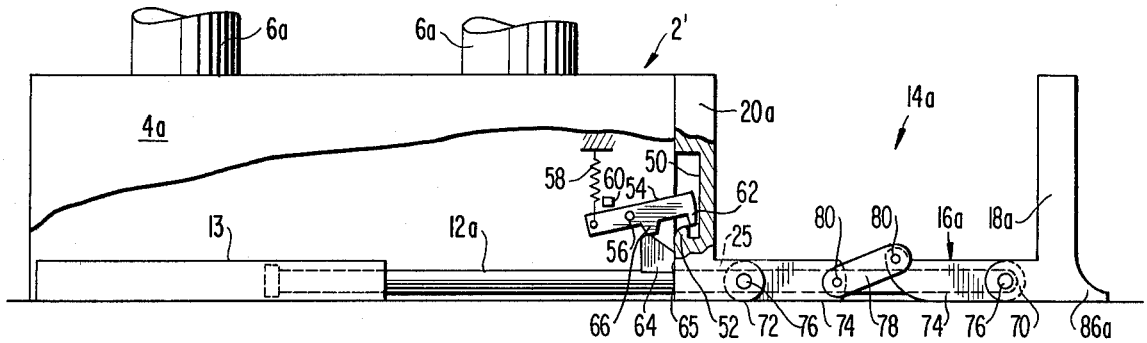
FIGS. 9 and 10 are views similar to FIG. 8, but showing successive steps in retracting the conveyor support and the shifting thereof to a condition in which it occupies an area of relatively small lateral extent.
Figure 10:
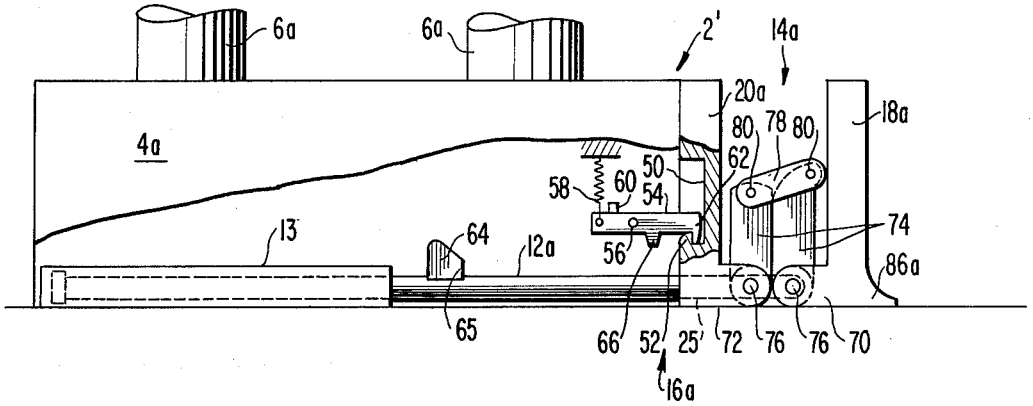

Referring now to FIGS. 7–10, the base **4*a* of a chock is essentially the same as the base 4 of chock 2 previously described except in this illustration ram 12*a* with its cylinder 13 are centrally disposed and only one such ram is illustrated for extending and retracting the channel section 14*a* and for shifting it from a normal condition in which it occupies a relatively wide area laterally of the chock front to a condition of relatively small or narrow area of occupancy (FIG. 10) adjacent the chock base. In this embodiment the base 16*a* from which flanges 18*a* and 20*a* extend upwardly is collapsible. On the inner side of flange 20*a* is a recess 50 having a lip 52 on its lower side. A latch 54 pivoted to base 4*a* at 56 is biased to swing clockwise as seen in FIGS. 8–10 by a spring 58 which normally pulls the inner end of the latch against a stop 60. On the outer end of latch 54 is a hook 62 which, when engaged over lip 52 locks flange 20*a* against the side of base 4*a***.

The outer end of ram **12*a* is rigidly connected at 23 to the inner side of flange 18*a*, the ram sliding through an aperture 25 near the bottom of flange 20*a*. Flanges 18*a*, 20*a* have on their inner sides arms 70, 72 to which links 74 are pivoted as at 76. Each of the pairs of links 74 is connected to a diagonal link 78 by pivots 80. On ram 12*a* is a cam 64 which engages against a follower 66 on latch 54, cam 64 also having a forward surface 65 which engages against flange 20*a*** as described hereinbelow.

When ram **12*a* is retracted it pulls in the flange 18*a*, links 74 buckle upwardly (FIG. 10), the flanges move in together towards base 4*a* until the hook 62 of latch 54 rides up over lip 66 and the hook drops down over lip 52 and locks flange 20*a* against base 4*a*. When the channel section 14*a* is to be extended and spread laterally, ram 12*a* moves outwardly to force flange 18 outwardly, links 74 unbuckle downwardly (FIG. 9), cam 64 engages the follower 66 on latch 54 and frees it from lip 52, the forward surface 65 on cam and 64 engages against flange 20 and as ram 12*a* continues to move outwardly, it forces the channel assembly back to its fully opened and spread condition of FIGS. 7 and 8**.

Figure 11:
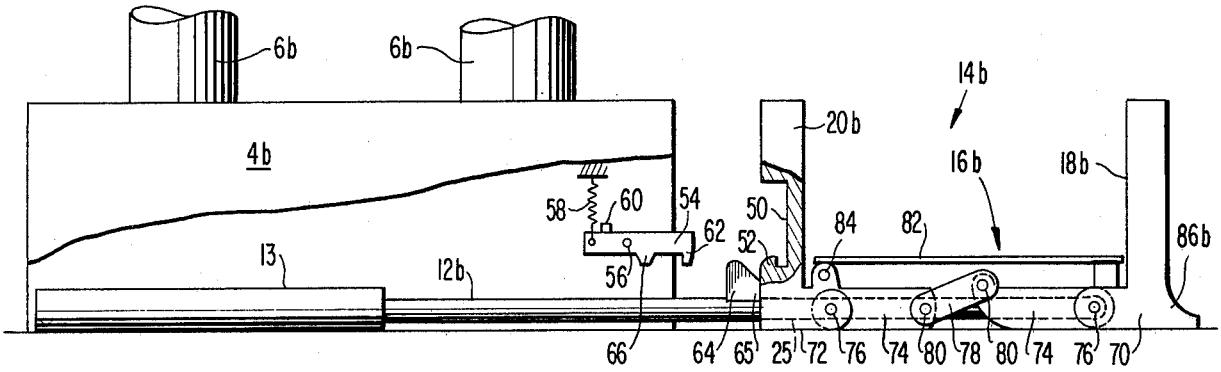
FIG. 11 is an end view of a chock with a second modification of a conveyor support extended at one side thereof.
Figure 12:
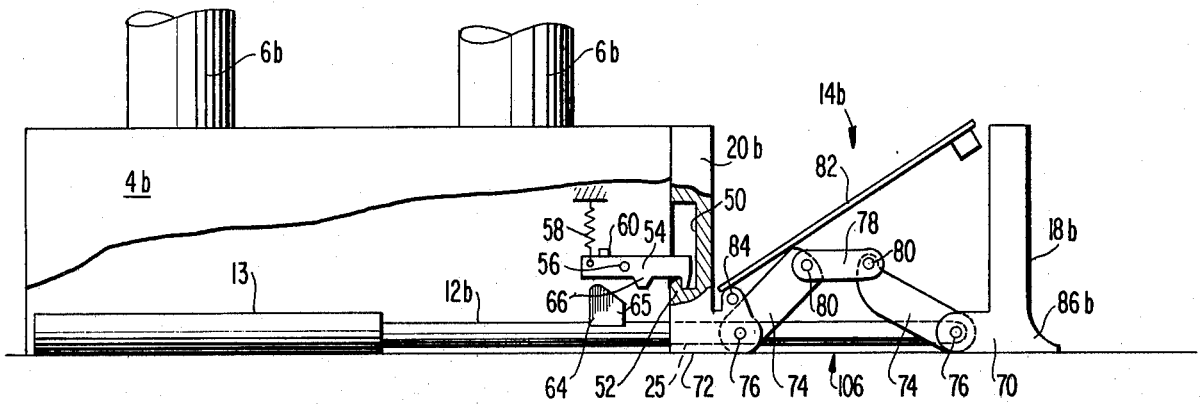
FIGS. 12 and 13 are views similar to FIG. 11, but showing successive steps in retracting the conveyor support and the shifting thereof to a condition in which it occupies an area of relatively small lateral extent.
Figure 13:
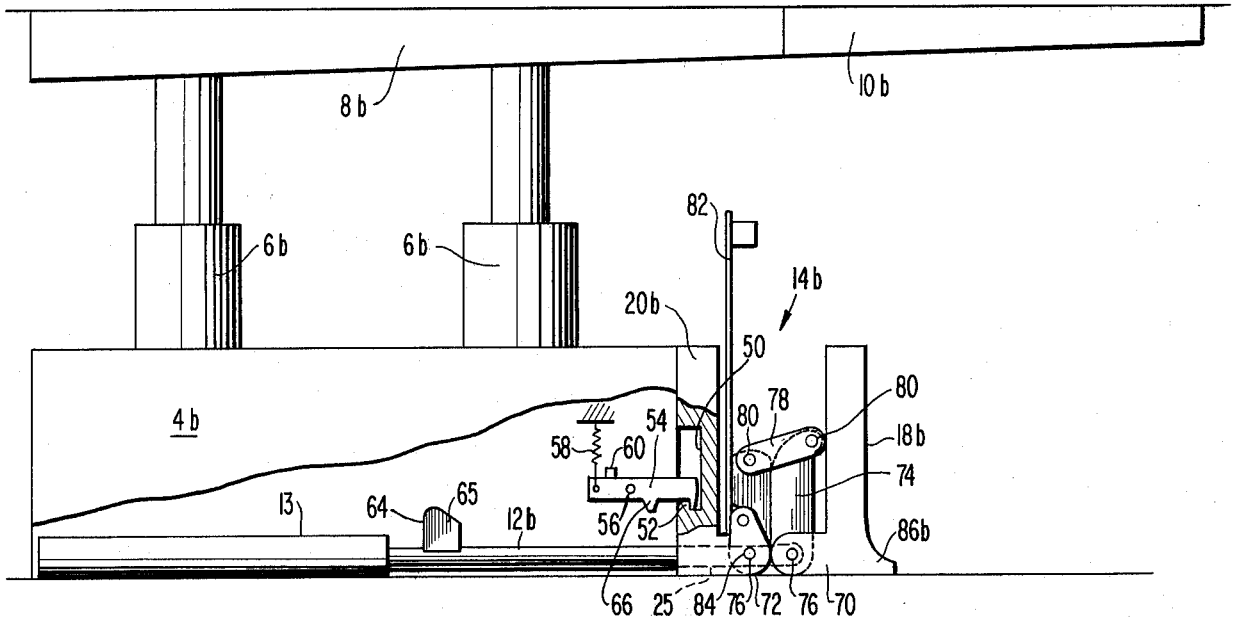

The FIGS. 11–13 embodiment is the same as that shown in FIGS. 7–10 except in that a floor plate 82 is pivoted at 84 to the arm 72 of flange **20*b*. When links 74 buckle upwardly, they force floor plate 82 to swing upwardly about pivot 84 to its FIG. 13** position.

Figure 14:
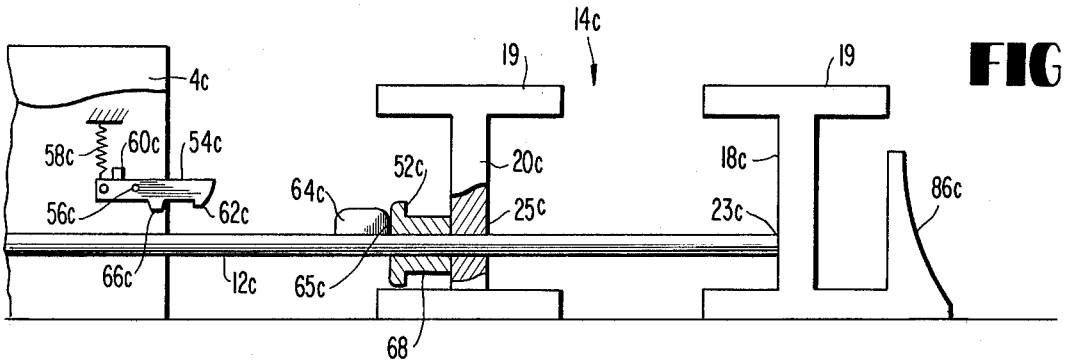
FIG. 14 is a fragmentary end view of a chock with a third modification of a conveyor support extended at one side thereof.
Figure 15:
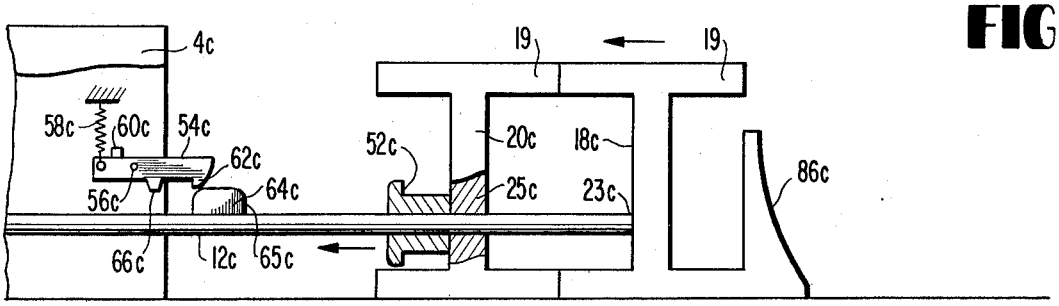
FIG. 15 is a view similar to FIG. 14, but showing the parts during a phase of retractive movement of the conveyor support.
Figure 16:
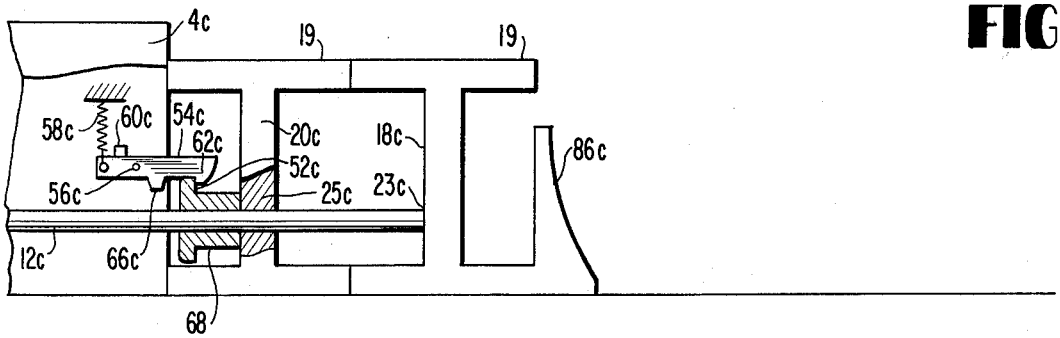
FIG. 16 is a view similar to FIGS. 14 and 15, but showing the parts with the conveyor support fully retracted and occupying an area of relatively small lateral extent; and, FIG. 17 is a view similar to FIG. 15, but showing the parts during a phase of extending movement and occupying an area of relatively large lateral extent.
Figure 17:
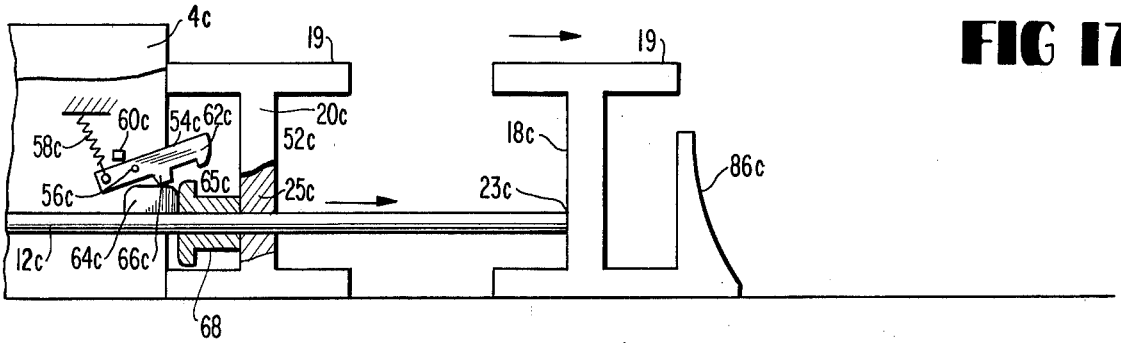

In the embodiment disclosed in FIGS. 14–17, the flanges **18*c* and 20*c* support rail tops 19 along which the wheels of a conveyor (not shown) roll. The outer end of ram 12*c* is rigidly connected as at 23*c* to flange 18*c* and the shank of the ram slides through an opening 25*c* through flange 20*c* and an abutment 68. FIG. 14 shows the conveyor support section 14*c* fully extended and spread laterally to its fullest extent. The first retractive movements of ram 12*c* draw flange 18*c* inwardly until its base 16*c* engages the base 16*c* of flange 20*c*. Further retractive movement of ram 12*c* draws flange 18*c* inwardly which crowds flange 20*c* inwardly against the chock base 14*c* (FIG. 16). As shown in FIG. 16, hook 62 of latch 54*c* has snapped over lip 52*c* so as to lock flange 20*c* in against the chock base. The first extension movements of ram 12*c* force flange 18*c* outwardly away from flange 20*c* until the FIG. 17 condition prevails. Cam 64*c* has engaged the follower 66*c* so as to lift the hook 62*c* free of lip 52*c* and the forward surface 65*c* of cam 64*c* engaged abutment 68 so that further outward movement of rams 12*c* extends the then-spread apart flanges 18*c*, 20*c* from their FIG. 17 position to their fully extended position of FIG. 14**.

As used herein, the term chock or chocks shall mean chocks, shields, or other related mechanical devices for roof support. The term mining machine shall refer to continuous miner, header, borer, auger, cutter, shearer, plow or other related commercial mechanical devices used to obtain minerals from the earth's crust. It is further noted that for the purpose of this specification and the appended claims that the term "conveyor systems" is not limited to the preferred embodiment, the multi-unit cascading train. It will be apparent to those skilled in the art that the back-out path clearing mechanisms with the ancillary support system is readily adaptable to support other conveyance systems such as flexible conveyor trains, hydraulic tube transport, pneumatic tube transport, the flexible frame endless conveyor, etc.

That portion of the method wherein a mining machine is advanced along a cut line through a panel, and individual roof chocks are moved up along the cut to form an advancing row of roof support behind the mining machine is known in the prior art. The formation of an advancing trackway behind the mining machine by joining adjacent ends of individual track sections supported on the forward sides of individual chocks is disclosed in our co-pending application.

In all embodiments, the lower outside edge of flange 18, 18*a*, 18*b* or 18*c* is provided with a dozer like blade 86, 86*a*, 86*b* or 86*c*, respectively, so as to push loose coal or debris away towards the mine rib when the conveyor support is extended. The material is then mined by the continuous miner on its next pass across the panel. Conventional drag chain conveyors have a plow on their leading edge which has both a different design and utility than this embodiment. It is short in height and scoops or plows under the loose material, moving it onto the drag conveyor for removal from the mine. According to this method of this operation, the same motions which spread out the conveyor support sections and extend it laterally outward from the chock base plows away and clears the path of the conveyor support guideway. In all embodiments, connecting means (not shown) may be used for joining the ends of the conveyor support associated with one chock base to the conveyor support section associated with the adjacent chock base. In all embodiments, the specific shape and sizes of the elements may vary, all within the purview of the apparatus and method defined in the following claims.

I claim:

1. A chock having a base, a ram horizontally moveable between inner and outer extremities at one side of said chock base, an articulated conveyor support member shiftable between two conditions in the first of which conditions said support member occupies an area of relatively wide extent as measured horizontally and in the second of which conditions said support member occupies an area of relatively narrow extent as measured horizontally, a connection between said ram and said articulated conveyor support member for moving the latter inwardly and outwardly with respect to the base, and means for shifting said support member from said first condition to said second condition upon movement of said ram from said outer extremity to said inner extremity and for shifting said support member from said second condition to the first condition upon movement of said ram from said inner extremity to said outer extremity, said articulated conveyor support member comprising a pair of flange members, in the first of which conditions said flange members are disposed in laterally spaced relation to one another and in the second of which conditions they are disposed in vertically spaced relation to one another.

2. A chock having a base, a ram moveable between inner and outer extremities at one side of said chock base, an articulated conveyor support member having a base portion which normally extends laterally outward at said side of said base, means connecting said ram to said support member for moving the latter between inner and outer extremities by corresponding movement of said ram, said means providing pivotal movement of said member between a generally horizontal position and a generally upright position, and interengaging means on said chock and said support member for rotating the latter about said horizontal pivot means upon movement thereof to its inner extremity, whereby to swing the base portion thereof from its normal laterally outward-extending position to an upright position adjacent the chock base.

3. The combination defined in claim 2, and means for releasably joining the ends of said support member to ends of like members which, joined end-to-end, constitute serial parts of said support.

4. The combination claimed in claim 2, said interengaging means including blocking surface means on said chock and said support member for retaining said support member in its upwardly-swung position while the latter remains at its inner extremity.

5. The combination claimed in claim 2, and interengaging means on said ram and said support member for locking the latter with the base portion thereof in its normal laterally outward extending position upon movement of said support member by said ram from the inner extremity of said support member towards the outer extremity thereof.

6. The combination claimed in claim 2, said interengaging means including blocking surface means on said chock and said support member for retaining said support member in its upwardly-swung position while the latter remains at its inner extremity, and interengaging means on said ram and said support member for locking the latter with the base portion thereof in its normal laterally outward extending position upon movement of said support member by said ram from the inner extremity of said support member towards the outer extremity thereof.

7. A chock having a base, a ram having a ram member extending horizontally outward from one side of said chock base and moveable between inner and outer extremities an articulated conveyor support having a base which normally extends horizontally outward at said side of said chock base and occupies an area of relative large lateral extent and a member on a side thereof which is disposed towards the chock base in the normal position of the support a horizontal pivotal connection between said members said horizontal pivotal connection providing for pivotal movement of said base from the normal position thereof to an upright position in which it occupies an area of relatively small lateral extent, said support being moveable between inner and outer extremities on said chock side upon corresponding movement of said ram, a cam on said side of said base and having an upwardly and outwardly facing cam surface thereon, and abutment surface means on said member of said support for engaging said cam whereby to pivot said conveyor support and thereby swing the base thereof upright when said support is moved to its inner extremity.

8. The combination defined in claim 7, and means for releasably joining the ends of said support member to ends of like members which, joined end-to-end, constitute serial parts of said support.

9. The combination claimed in claim 7, said abutment surface means having a flat portion which faces the ram base when said support is in its normal position and being so disposed with respect to the upper surface of said cam as to rest thereon when said support is at its inner extremity with its base upright.

10. The combination claimed in claim 7, the member on the support comprising a socket having an open inner end which faces laterally outward from the last-named member and a pair of laterally spaced side walls on the outer end thereof and into the inner ends of which socket the end of said rams is engageable, said pivoted connection being of the lost-motion type and comprising a pivot pin spaced inwardly from the end of said ram and slidably engaging in a pair of slots which are elongate in the axial direction of the socket.

11. The combination claimed in claim 7, said abutment surface means having a flat portion which faces the ram base when said support is in its normal position and being so disposed with respect to the upper surface of said cam as to rest thereon when said support is at its inner extremity with its base upright, the member on the support comprising a socket having an open inner end which faces laterally outwardly from the last-named member and a pair of laterally spaced side walls on the outer end thereof and into the inner ends of which socket the end of said ram is engageable, said pivoted connection being of the lost-motion type and comprising a pivot pin spaced inwardly from the end of said ram and slidably engaging in a pair of slots which are elongate in the axial direction of the socket.

12. A chock having a base, a ram horizontally moveable between inner and outer extremities at one side of said chock base, an articulated conveyor support member shiftable between two conditions in the first of which conditions said support member occupies an area of relatively wide extent as measured horizontally and in the second of which conditions said support member occupies an area of relatively narrow extent as measured horizontally, a connection between said ram and said articulated conveyor support member for moving the latter inwardly and outwardly with respect to the base, and means for shifting said support member from said first condition to said second condition upon movement of said ram from said outer extremity to said inner extremity and for shifting said support member from said second condition to the first condition upon movement of said ram from said inner extremity to said outer extremity, said conveyor support member comprising a pair of flange members disposed laterally of one another, the means for shifting said support member from one condition to the other including a collapsible framework connecting said flange members.

13. The combination defined in claim 12, said collapsible framework including upwardly buckling linkage members connected between said flanges, and a normally horizontal floor plate engaged over said member whereby upon upward buckling thereof, said floor plate moves upwardly therewith to a vertical position.

14. A chock having a base, a ram horizontally moveable between inner and outer extremities at one side of said chock base, an articulated conveyor support member shiftable between two conditions in the first of which conditions said support member occupies an area of relatively wide extent as measured horizontally and in the second of which conditions said support member occupies an area of relatively narrow extent as measured horizontally, a connection between said ram and said articulated conveyor support member for moving the latter inwardly and outwardly with respect to the base, and means for shifting said support member from said first condition to said second condition upon movement of said ram from said outer extremity to said inner extremity and for shifting said support member from said second condition to the first condition upon movement of said ram from said inner extremity to said outer extremity, said conveyor support members comprising a pair of said members disposed laterally of one another, one being an inner rail member which is disposed relatively towards the chock base and the other being an outer rail member which is disposed relatively away from the chock base, said ram having an outer end affixed to the outer rail member, and a lost-motion connection between the ram and the inner rail member.

15. The combination claimed in claim 14, and a plow on the outside of the outer rail member.

16. A chock having a base, a ram horizontally moveable between inner and outer extremities at one side of said chock base, an articulated conveyor support member including at least two portions which are normally spaced laterally from one another for supporting a conveyor on both portions thereof, said conveyor support member being shiftable between extended and retracted conditions, in the extended of which conditions said portions embrace an area of relatively wide lateral extent as measured horizontally in front of the chock base and in the retracted of which conditions said portions embrace an area of relatively narrow lateral extent as measured horizontally in front of the chock base, a connection between said ram and said articulated conveyor support member for moving the latter inwardly and outwardly with respect to the base, and means for shifting said support member from said extended condition to said retracted condition upon movement of said ram from said outer extremity to said inner extremity and for shifting said support member from said retracted condition to the extended condition upon movement of said ram from said inner extremity to said outer extremity.

* * * * *